US009373244B2

(12) United States Patent
Hu

(10) Patent No.: US 9,373,244 B2
(45) Date of Patent: Jun. 21, 2016

(54) BASE AND DISPLAY DEVICE HAVING A SENSING COMPONENT FOR DETECTING A REMOTE CONTROLLER

(71) Applicant: BOE TECHNOLOGY GROUP CO., LTD, Beijing (CN)

(72) Inventor: Nannan Hu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 119 days.

(21) Appl. No.: 14/315,841

(22) Filed: Jun. 26, 2014

(65) Prior Publication Data

US 2015/0269831 A1 Sep. 24, 2015

(30) Foreign Application Priority Data

Mar. 20, 2014 (CN) ..... 2014 1 0105994

(51) Int. Cl.
*G08B 21/00* (2006.01)
*G08B 21/24* (2006.01)

(52) U.S. Cl.
CPC ..... *G08B 21/24* (2013.01)

(58) Field of Classification Search
CPC ..... G08B 21/24
USPC ..... 340/8.1
See application file for complete search history.

(56) References Cited

U.S. PATENT DOCUMENTS 5,790,021 A * 8/1998 Mickel ..... G08B 21/0216 206/320
6,445,290 B1 * 9/2002 Fingal ..... G08B 1/24 340/12.54
8,564,418 B2 * 10/2013 Kimura ..... B60R 11/0264 340/12.1
2005/0270167 A1 12/2005 Lai et al.
2007/0279245 A1 * 12/2007 Sholem ..... H01H 9/025 340/12.22
2009/0273485 A1 11/2009 Wike
2011/0043709 A1 * 2/2011 Hirata ..... G08C 17/00 348/734
2013/0021534 A1 1/2013 Hill et al.

FOREIGN PATENT DOCUMENTS

CN 101686355 A 3/2010
CN 20135838 U 8/2013

OTHER PUBLICATIONS

1st office action issued in Chinese application No. 201410105994.3 dated Sep. 30, 2015.

* cited by examiner

*Primary Examiner* — Mark Rushing
(74) *Attorney, Agent, or Firm* — Nath, Goldberg & Meyer; Joshua B. Goldberg; Christopher Thomas

(57) ABSTRACT

The present invention provides a base, which includes a base body used to support a display panel, wherein the base further includes an alarm device being capable of emitting an alarm signal. The alarm device includes an alarm element and a sensing component for detecting a remote controller. A placement groove is capable of accommodating the remote controller therein is provided in the base body. The sensing component is provided in the placement groove, and the alarm element is capable of emitting the alarm signal in the case of the sensing component failing to detect the remote controller after the display panel is powered off. (FIG. 1)

18 Claims, 4 Drawing Sheets

BASE AND DISPLAY DEVICE HAVING A SENSING COMPONENT FOR DETECTING A REMOTE CONTROLLER

FIELD OF THE INVENTION

The present invention relates to the field of display devices, in particular, relates to a base used to support a display device and a display device including the base.

BACKGROUND OF THE INVENTION

Many display devices (e.g., a television set) include a remote controller used to perform remote operation on the display devices. After finishing usage of the display device, a user tends to place the remote controller around inadvertently. When the user is going to use the display device next time, it often takes the user a certain time to look for the remote controller, which causes an obvious inconvenience.

CN 201414167Y discloses a television set with a function of looking for a remote controller, wherein the remote controller and the television set can perform wireless communication with each other, and the remote controller is provided with a speaker. When being turned on, the television set can send out a signal to perform wireless communication with the remote controller, so as to make the remote controller emit a sound to indicate the location of the remote controller.

However, such a television set is merely adapted to a specific kind of remote controllers, which is inconvenient for the remote controller being replaced when it is damaged. Furthermore, it is necessary to provide a wireless communication element on both the television set and the remote controller, which increases a cost of production.

SUMMARY OF THE INVENTION

An object of the present invention is to provide a base used to support a display device and a display device including the base. A remote controller of the display device would not easy to be lost, and the display device is adapted to various general remote controllers.

In order to achieve the above object, as one aspect of the present invention, there is provided a base including a base body used to support a display panel, wherein, the base further includes an alarm device being capable of emitting an alarm signal and including an alarm element and a sensing component for detecting a remote controller, a placement groove being capable of accommodating the remote controller therein is provided in the base body, the sensing component is provided in the placement groove, and the alarm element is capable of emitting the alarm signal in the case of the sensing component failing to detect the remote controller after the display panel is powered off.

Preferably, the alarm device further includes a control module, both the sensing component and the alarm element are electrically connected to the control module, and the control module controls the alarm element to emit the alarm signal in the case of the sensing component failing to detect the remote controller when the display panel is powered off.

Preferably, the alarm device further includes a display-panel-state determination module whose one end is electrically connected to a system board of the display panel, and the other end is electrically connected to the control module, and which is configured for determining whether the display panel is powered on.

Preferably, the alarm device further includes a power supply including a battery, the battery is capable of being connected to an external power supply which supplies power to the display panel, wherein when the external power supply is turned on, the external power supply supplies power to the alarm device and charges the battery;

when the external power supply is turned off, the battery supplies power to the alarm device.

Preferably, the sensing component includes a transmitter and a receiver oppositely provided in the placement groove, the transmitter transmit a detection signal when the display panel is powered off, the receiver generates an inductive signal as receiving the detection signal transmitted from the transmitter and sends the inductive signal to the control module, and the control module controls the alarm element to emit the alarm signal according to the inductive signal.

Preferably, the transmitter is capable of transmitting an infrared ray, the receiver is capable of receiving the infrared ray and generating the inductive signal.

Preferably, the shape of the placement groove matches with the shape of the remote controller.

Preferably, the shape of an upper surface of the remote controller matches with an upper surface of the base, such that the upper surface of the remote controller is continuous with the upper surface of the base when the remote controller is placed in the placement groove, and a notch is provided on at least one sidewall of the placement groove.

Preferably, the alarm element includes a speaker and/or an indicator lamp.

As another aspect of the present invention, there is provided a display device including a display panel, a base supporting the display panel, and a remote controller for remote controlling the display device, wherein the base is the above-mentioned base according to the present invention.

Preferably, the display device is capable of receiving a television signal.

After a user would stop watching contents displayed by the display panel and turn off the display panel, in a case where the remote controller is not placed in the placement groove, the alarm device emits an alarm signal to remind the user of placing the remote controller into the placement groove. The alarm device will stop emitting an alarm signal upon the remote controller being placed into the placement groove. An advantage of the base according to the present invention is to avoid a remote controller being placed around inadvertently by the user, thus can save time of looking for the remote controller when next time the display device is going to be turned on.

In addition, the base according to the present invention is adapted to any kind of remote controller. Even a present remote controller damages, a user can conveniently replace the present remote controller with another remote controller capable of remote controlling the display panel.

BRIEF DESCRIPTION OF THE DRAWINGS

The drawings are to provide better understanding of the present invention, and constitute a part of the description. Together with the following embodiments, the drawings serve to describe the present invention, but not to limit the present invention. Wherein.

Figure 1:
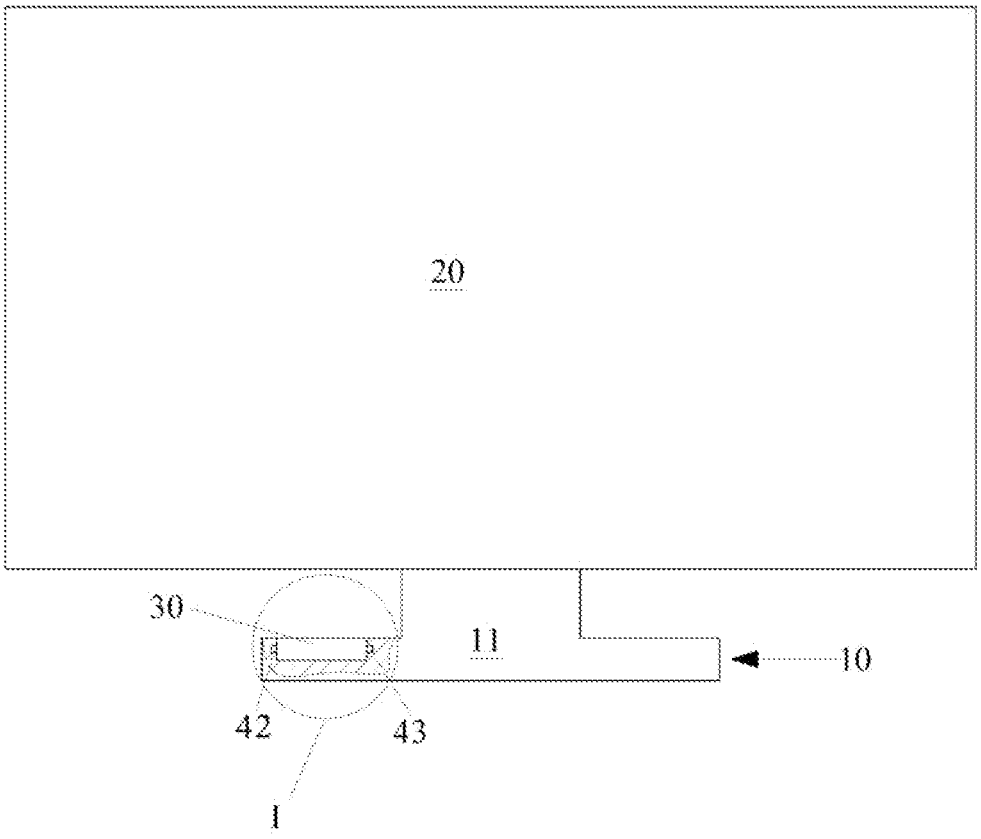
FIG. 1 is a schematic front view showing the display device according to the present invention.

| Description of reference signs: | |
|---|---|
| 10: base | 11: base body |
| 12: placement groove | 20: display panel |
| 30: remote controller | 40: alarm device |
| 41: control module | 42: transmitter |
| 43: receiver | 44: alarm element |
| 45: display-panel-state determination module | 46: power supply |

DETAILED DESCRIPTION OF THE EMBODIMENTS

Embodiments of the present invention will be described in detail below with reference to the drawings. It should be understood that the embodiments described herein are only for the purpose of describing and explaining the present invention, but not to limit the present invention.

As shown in FIGS. 1 to 5, as one aspect of the present invention, there is provided a base 10 including a base body 11 used to support a display panel 20, wherein the base 10 further includes an alarm device 40 (see FIG. 5) capable of emitting an alarm signal. The alarm device 40 includes an alarm element 44 and a sensing component for detecting a remote controller 30. A placement groove 12 capable of accommodating the remote controller 30 therein is provided in the base body 11. The sensing component is provided in the placement groove 12, and the alarm element 44 can emit the alarm signal after the display panel 20 is powered off and when the sensing component does not detect the remote controller 30.

After a user finishes watching contents displayed by the display panel 20 and turns off the display panel 20, if the sensing component does not detect the remote controller 30, the alarm device will emit an alarm signal to remind the user to place the remote controller 30 into the placement groove. After the remote controller 30 being placed into the placement groove, the sensing component can detect the remote controller 30, and the alarm device will stop emitting the alarm signal. An advantage of the base according to the present invention is to prevent a user from placing a remote controller around inadvertently, thus a time to look for the remote controller when the display device is turned on next time is saved.

In addition, the base according to the present invention is adapted to any kind of remote controller, as long as the remote controller can be placed in the placement groove 12. Even a present remote controller damages, a user can conveniently replace the present remote controller with another remote controller being capable of remote controlling the display panel.

In the present invention, the sensing component is not limited to the specific form herein. For example, as an embodiment of the present invention, the sensing component may include a normally closed switch provided on a circuit through which the alarm element and a power supply are connected. When the remote controller is placed in the placement groove, the normally closed switch becomes open circuit, so that the alarm element and the power supply are disconnected. When the remote controller is not placed in the placement groove, the normally closed switch stays closed, so that the alarm element is electrically connected to the power supply and emits an alarm signal.

In the present invention, the alarm device may be configured to electrically connect to the display panel 20, so that it can be determined whether the display panel 20 is in a power-on state (i.e., a display state) or in a power-off state by the alarm device.

Figure 5:
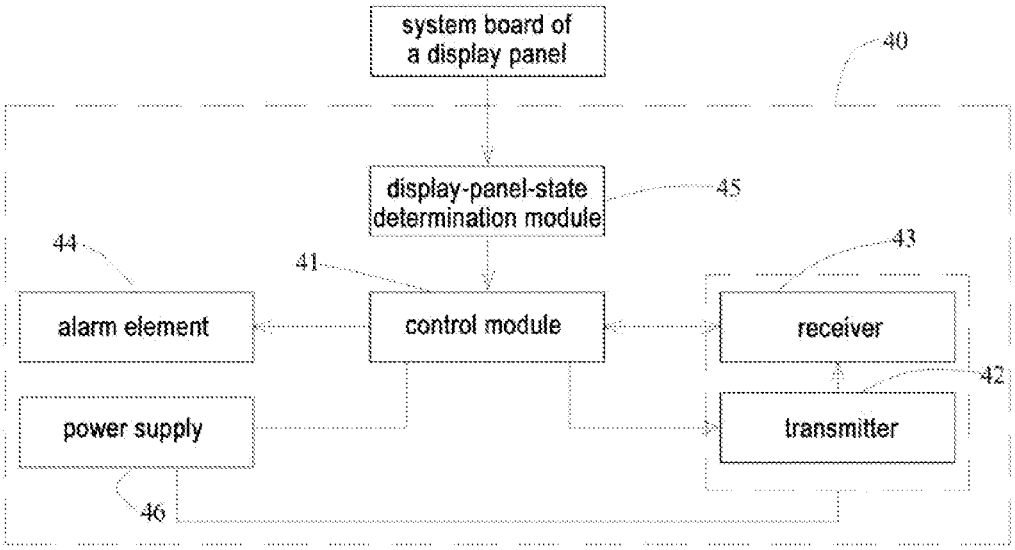
FIG. 5 is a schematic diagram of an alarm device in a base.

Alternatively, the sensing component may be an electronic sensing component. In this case, as shown in FIG. 5, the alarm device 40 may further include a control module 41. Both the sensing component and the alarm element 44 are electrically connected to the control module 41.

When the display panel is powered on (i.e., when the display panel normally displays), it means that a user is watching the contents displayed by the display panel. In this case, the remote controller would not be in the placement groove 12, and the control module 41 control the alarm element 41 not to emit an alarm signal (or, control the alarm element 41 to be in a power-off state).

When the display panel is powered off (including two states: one state in which the display panel stands by, and another state in which the display panel is totally powered off) and the sensing component does not detect the remote controller, the sensing component sends a signal indicative of not detecting the remote controller to the control module 41. After receiving the signal indicative of failing to detect the remote controller, the control module 41 controls the alarm element 44 to emit an alarm signal. When the display panel is powered off, it means that the user does not watch the contents displayed by the display device anymore and turns off the display panel. In this case, if the sensing component fails to detect the remote controller, it means that the remote controller is not placed in the placement groove. In order to avoid the remote controller being placed inadvertently by the user, the control module 41 controls the alarm element 44 to emit an alarm signal, so as to remind the user to place the remote controller into the placement groove.

Figure 6:
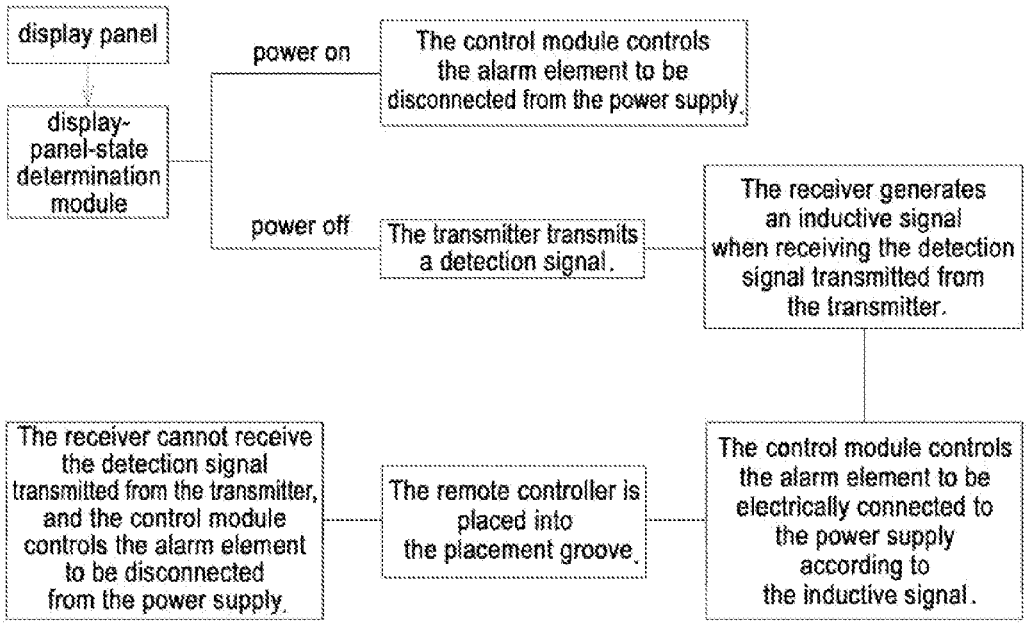
FIG. 6 is a work flow chart of the base according to an embodiment of the present invention.

As an embodiment of the present invention, as shown in FIG. 6, when a display-panel-state determination module determines that the display panel is powered off and the control module receives an inductive signal sent by the sensing component, the control module can control the alarm element to be connected to a power supply, which can supply electric power required for the alarm element to emit an alarm signal. When the display-panel-state determination module determines that the display panel is in a power-on state, or, when display-panel-state determination module determines that the display panel is in a power-off state and the control module does not receive the inductive signal sent by the sensing component, the control module can control the alarm element to be disconnected from the power supply, so as to not emit an alarm signal.

Figure 7:
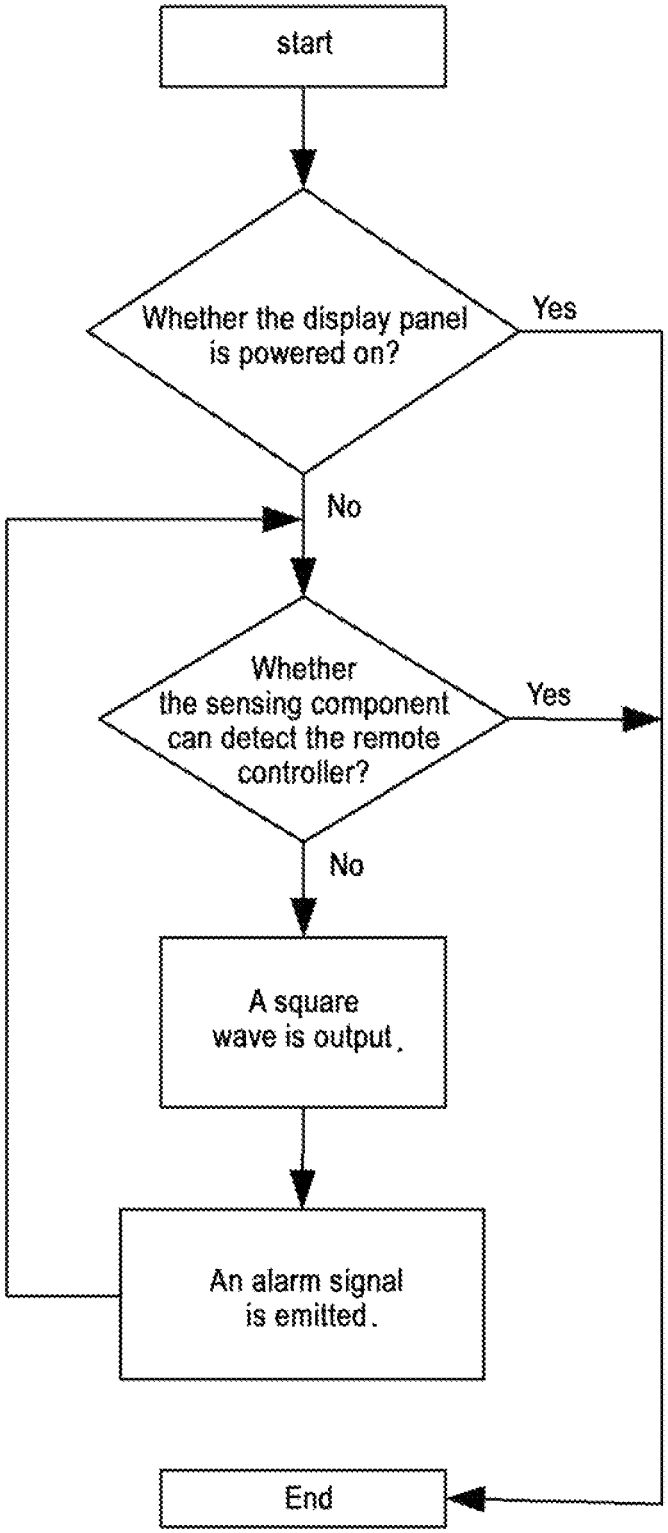
FIG. 7 is a work flow chart of the base according to another embodiment of the present invention.

As another embodiment of the present invention, as shown in FIG. 7, the control module 41 may be a micro control unit (MCU) being capable of generating a square wave. When receiving the square wave, the alarm element 44 can emit the alarm signal. In the present invention, the alarm element may include a speaker and/or an indicator lamp. Thus, the alarm element 44 can emit a reminder tone and/or blinker light to remind the user that the remote controller is not placed in the placement groove.

In order to accurately determine whether the display panel is powered on, preferably, the alarm device 40 may further include a display-panel-state determination module 45 used for determining whether the display panel is powered on. One end of the display-panel-state determination module 45 is electrically connected to a system board of the display panel, and the other end of the display-panel-state determination module 45 is electrically connected to the control module 41.

When it is detected that the display panel is in a power-on state, the display-panel-state determination module 45 sends a signal "1" to the control module 41. After receiving the signal "1", the control module 41 controls a power supply 46 to be disconnected from the alarm element 44, so that the alarm element 44 does not emit an alarm signal. When it is detected that the display panel is in a power-off state, the display-panel-state determination module 45 sends a signal "0" to the control module 41. After the control module 41 receives the signal "0" and when the sensing component fails to detect the remote controller, the control module 41 controls the power supply 46 to be electrically connected to the alarm element 44, so that the alarm element 44 emits an alarm signal.

As described above, the power supply in the present invention is not limited to the specific structure herein. For example, the power supply includes a battery. The battery is capable of being connected to an external power supply which supplies power to the display panel. The alarm element is connected to both the battery and the external power supply. That is, the alarm element is connected to not only the battery but also the external power supply.

When the external power supply is turned on (including two states: one state in which the display panel is powered on, and another state in which the display panel stands by), the external power supply supplies power to the alarm device and charges the battery. When the external power supply is turned off, the battery supplies power to the alarm device.

A chargeable battery may be configured to supply power required for the alarm device 40 to operate when the external power supply of the display panel is turned off, so that it is ensured that when the display device is totally powered off and when the remote controller is not placed in the placement groove, the alarm device can emit an alarm signal to remind the user to place the remote controller into the placement groove.

As described above, the sensing component in the present invention is not limited to the specific form herein. The sensing component may include the normally closed switch as described above.

Figure 2:
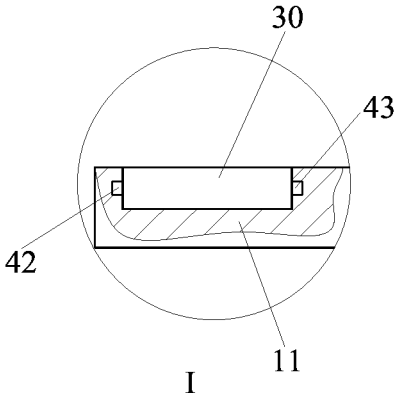
FIG. 2 is an enlarged view showing part I of the display device shown in FIG. 1.
Figure 3:
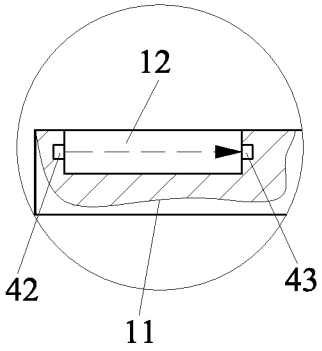
FIG. 3 is a schematic diagram of a placement groove without any remote controller placed therein.
Figure 4:
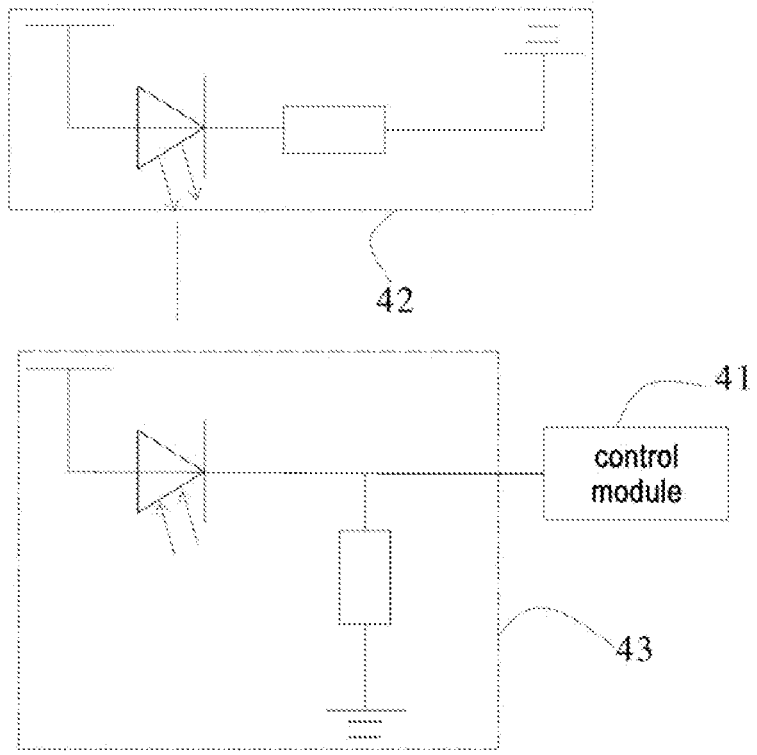
FIG. 4 is a circuit diagram of a sensing component in an alarm device.

In order to improve the life of the sensing component, as a preferred embodiment of the present invention, as shown in FIGS. 2 to 4, the sensing component may include a transmitter 42 and a receiver 43 which are oppositely provided in the placement groove. The transmitter 42 can transmit a detection signal when the display panel is powered off, the receiver 43 generates an inductive signal when receiving the detection signal transmitted from the transmitter 42 and sends the inductive signal to the control module. The control module controls the alarm element to emit the alarm signal according to the inductive signal.

Specifically, as shown in FIG. 3, when the placement groove 12 does not accommodate a remote controller therein, the detection signal transmitted from the transmitter 42 can reach the receiver 43. As shown in FIG. 2, when the placement groove 12 accommodates a remote controller 30 therein, the remote controller 30 blocks the detection signal transmitted from the transmitter 42, so that the detection signal transmitted from the transmitter 42 cannot reach the receiver 43.

Neither the transmitter 42 nor the receiver 43 directly contacts with a remote controller, thus will not wear or easily damage.

The transmitter 42 in the present invention is not limited to the specific form herein. For example, the transmitter 42 may be a laser generator, and the detection signal is a laser signal. Meanwhile, the receiver 43 can receive the laser signal and generate the inductive signal.

Alternatively, the transmitter 42 can emit an infrared ray, and the receiver 43 can receive the infrared ray and generate the inductive signal. Specifically, as shown in FIG. 4, the transmitter 42 may include a light-emitting diode, and the receiver 43 may include a light-sensitive diode. When the light-sensitive diode in the receiver 43 receives light emitted by the light-emitting diode in the transmitter 42, the circuit of the receiver 43 is turned on, so that the receiver 43 sends the inductive signal to the control module 41.

Preferably, the shape of the placement groove matches with the shape of the remote controller in the present invention.

When the remote controller is placed in the placement groove, the remote controller may protrude from the base, so that the remote controller is taken out from the placement groove easily.

In order to not affect an aesthetic appearance of the display device, preferably, the shape of an upper surface of the remote controller matches with an upper surface of the base, such that the upper surface of the remote controller is continuous with the upper surface of the base when the remote controller is placed in the placement groove. A notch is provided on at least one sidewall of the placement groove, so as to facilitate taking out the remote controller from the placement groove. When the remote controller is placed in the placement groove, a part of side surface of the remote controller is exposed through the notch. When need to take out the remote controller from the placement groove, the user can insert his/her fingers into the notch to take the remote controller out.

As another aspect of the present invention, as shown in FIG. 1, there is provided a display device including a display panel 20, a base 10 supporting the display panel 20, and a remote controller 30 for remote controlling the display device, wherein the base is the above-mentioned base according to the present invention.

After a user would stop watching contents displayed by the display panel 20 and turn off the display panel 20, in a case where the remote controller 30 is not placed in the placement groove, the alarm device emits an alarm signal to remind the user to place the remote controller 30 into the placement groove. Upon the remote controller 30 being placed into the placement groove, the alarm device stops emitting an alarm signal. An advantage of the display device according to the present invention is to avoid a remote controller being placed around inadvertently by a user, thus can save time of looking for the remote controller when next time the display device is going to be turned on.

The present invention can be applied to a television set, i.e., the display device is capable of receiving a television signal.

An operation method of the display device according to the present invention will be described below with reference to FIG. 6. When the display-panel-state determination module determines that the display panel is in a power-on state, or, when the display-panel-state determination module determines that the display panel is in a power-off state and the control module does not receive the inductive signal sent by the receiver, the control module controls the alarm element to be disconnected from the power supply, so that the alarm element can not emit an alarm signal. When the display-panel-state determination module determines that the display panel is powered off and the receiver receives the detection signal transmitted from the transmitter and generates an inductive signal, the control module controls the alarm element to be connected to the power supply according to the inductive signal, so that the alarm element emits an alarm signal. After being reminded by the alarm signal, the user places the remote controller into the placement groove, which causes the receiver cannot receive the detection signal transmitted from the transmitter. Thus, the receiver stops generating an inductive signal, and the control module controls the alarm element to be disconnected from the power supply.

It should be understood that, the foregoing embodiments are only exemplary embodiments used to explain the principle of the present invention, and the present invention is not limited thereto. Variations and improvements easily conceived by a person having ordinary skill in the art without departing from the spirit and essence of the present invention all fall within the protection scope of the present invention.

What is claimed is:

1. A base including a base body used to support a display panel, wherein, the base further includes an alarm device being capable of emitting an alarm signal and including an alarm element and a sensing component for detecting a remote controller, a placement groove being capable of accommodating the remote controller therein is provided in the base body, the sensing component is provided in the placement groove, and the alarm element emits the alarm signal in the case of the sensing component failing to detect the remote controller after the display panel is powered off.

2. The base according to claim 1, wherein the alarm device further includes a control module, both the sensing component and the alarm element are electrically connected to the control module, and the control module controls the alarm element to emit the alarm signal in the case of the sensing component failing to detect the remote controller when the display panel is powered off.

3. The base according to claim 2, wherein the alarm device further includes a display-panel-state determination module whose one end is electrically connected to a system board of the display panel, and the other end is electrically connected to the control module, and which is configured for determining whether the display panel is powered on.

4. The base according to claim 1, wherein the alarm device further includes a power supply including a battery, the battery is capable of being connected to an external power supply which supplies power to the display panel, wherein when the external power supply is turned on, the external power supply supplies power to the alarm device and charges the battery;

when the external power supply is turned off, the battery supplies power to the alarm device.

5. The base according to claim 2, wherein the sensing component includes a transmitter and a receiver oppositely provided in the placement groove, the transmitter transmit a detection signal when the display panel is powered off, the receiver generates an inductive signal as receiving the detection signal transmitted from the transmitter and sends the inductive signal to the control module, and the control module controls the alarm element to emit the alarm signal according to the inductive signal.

6. The base according to claim 5, wherein the transmitter is capable of transmitting an infrared ray, the receiver is capable of receiving the infrared ray and generating the inductive signal.

7. The base according to claim 1, wherein the shape of the placement groove matches with the shape of the remote controller.

8. The base according to claim 7, wherein the shape of an upper surface of the remote controller matches with an upper surface of the base, such that the upper surface of the remote controller is continuous with the upper surface of the base when the remote controller is placed in the placement groove, and a notch is provided on at least one sidewall of the placement groove.

9. The base according to claim 1, wherein the alarm element includes a speaker and/or an indicator lamp.

10. A display device including a display panel, a base supporting the display panel, and a remote controller for remote controlling the display device, wherein the base includes a base body used to support the display panel, and the base further includes an alarm device being capable of emitting an alarm signal and including an alarm element and a sensing component for detecting the remote controller, a placement groove being capable of accommodating the remote controller therein is provided in the base body, the sensing component is provided in the placement groove, and the alarm element emits the alarm signal in the case of the sensing component failing to detect the remote controller after the display panel is powered off.

11. The display device according to claim 10, wherein the alarm device further includes a control module, both the sensing component and the alarm element are electrically connected to the control module, and the control module controls the alarm element to emit the alarm signal in the case of the sensing component failing to detect the remote controller when the display panel is powered off.

12. The display device according to claim 11, wherein the alarm device further includes a display-panel-state determination module whose one end is electrically connected to a system board of the display panel, and the other end is electrically connected to the control module, and which is configured for determining whether the display panel is powered on.

13. The display device according to claim 10, wherein the alarm device further includes a power supply including a battery, the battery is capable of being connected to an external power supply which supplies power to the display panel, wherein when the external power supply is turned on, the external power supply supplies power to the alarm device and charges the battery;

when the external power supply is turned off, the battery supplies power to the alarm device.

14. The display device according to claim 11, wherein the sensing component includes a transmitter and a receiver oppositely provided in the placement groove, the transmitter transmit a detection signal when the display panel is powered off, the receiver generates an inductive signal as receiving the detection signal transmitted from the transmitter and sends the inductive signal to the control module, and the control module controls the alarm element to emit the alarm signal according to the inductive signal.

15. The display device according to claim 14, wherein the transmitter is capable of transmitting an infrared ray, the receiver is capable of receiving the infrared ray and generating the inductive signal.

16. The display device according to claim 10, wherein the shape of the placement groove matches with the shape of the remote controller.

17. The display device according to claim 16, wherein the shape of an upper surface of the remote controller matches with an upper surface of the base, such that the upper surface of the remote controller is continuous with the upper surface of the base when the remote controller is placed in the placement groove, and a notch is provided on at least one sidewall of the placement groove.

18. The display device according to claim 10, wherein the alarm element includes a speaker and/or an indicator lamp.

* * * * *